US006603936B2

(12) United States Patent
Murata et al.

(10) Patent No.: US 6,603,936 B2
(45) Date of Patent: Aug. 5, 2003

(54) FIXING APPARATUS AND FIXING METHOD

(75) Inventors: Hiroshi Murata, Kanagawa-ken (JP); Masashi Hiroki, Kanagawa-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/750,146

(22) Filed: Dec. 29, 2000

(65) Prior Publication Data

US 2002/0085851 A1 Jul. 4, 2002

(51) Int. Cl.[7] ..... G03G 15/20
(52) U.S. Cl. ..... 399/69
(58) Field of Search ..... 399/69, 330, 331, 399/336

(56) References Cited

U.S. PATENT DOCUMENTS 5,138,392 A * 8/1992 Kinoshita et al. ..... 399/69 X
5,671,462 A * 9/1997 Toyohara et al. ..... 399/330 X
5,890,047 A * 3/1999 Moser ..... 399/330 X
5,974,294 A * 10/1999 Tange ..... 399/330 X
6,101,346 A * 8/2000 Arakawa ..... 399/69 X

FOREIGN PATENT DOCUMENTS

JP 11-344885 12/1999

* cited by examiner

*Primary Examiner*—Fred L. Braun
(74) *Attorney, Agent, or Firm*—Foley & Lardner

(57) ABSTRACT

The fixing apparatus includes a first heating arrangement in the form of an endless belt which heats recording medium having a developing agent image thereon. It additionally includes a pressing arrangement in the form of a roller which fixes the developing agent image by catching and conveying the recording medium in cooperation with the first heating arrangement; a second heating roller which comes into contact with the endless belt to heat it to a predetermined temperature; a plurality of heaters that are disposed in the second heating arrangement and have different outputs; and a control arrangement which controls the plurality of heaters. The heaters are selectively energized according to a temperature raising/elevating mode of the fixing apparatus, an image mode and a property of the paper from which the recording medium is made.

35 Claims, 6 Drawing Sheets

| OPERATION MODE | | | HIGH-OUTPUT HEATER (500W) | LOW-OUTPUT HEATER (200W) |
|---|---|---|---|---|
| TEMPERATURE RAISING MODE | WARM-UP MODE | | ON | ON |
| | STANDBY MODE | | OFF | ON |
| | FIRST COPY MODE | | ON | ON |
| PRINTING OPERATION | QUATERNATE TANDEM TYPE | COLOR OVERLAYING MODE (FULL-COLOR IMAGE) | ON | ON |
| | | NON-COLOR OVERLAYING MODE (PRINTED IMAGE) | ON | OFF |
| | INTERMEDIATE TRANSFER TYPE | COLOR OVERLAYING MODE (FULL-COLOR IMAGE) | ON | OFF |
| | | NON-COLOR OVERLAYING MODE (PRINTED IMAGE) | ON | ON |
| THICKNESS OF PAPER | QUATERNATE TANDEM TYPE | PLAIN PAPER MODE ($80g/m^2$) | ON | OFF |
| | | THICK PAPER MODE ($150 \sim 200g/m^2$) | ON | ON |

FIG. 5

FIXING APPARATUS AND FIXING METHOD

BACKGROUND OF THE INVENTION

1. Field of the Invention

The invention relates to a fixing apparatus and a fixing method for fixing a developing agent image on a recording medium by heating and pressing by a heated endless fixing belt.

2. Description of the Related Art

Recently, as a fixing apparatus which is used for image forming devices such as electrophotographic copy machines and printers to fix a toner image to a sheet of paper by heating and pressing, there is developed a belt type fixing apparatus which heats an endless belt type fixing belt and passes the sheet of paper through a nip portion between the fixing belt and a pressing roller which is in pressing contact with the fixing belt to fix the toner image by heating and pressing because a fixing temperature has high uniformity and high temperature resumability and a good fixing property can be obtained for an image which has toners overlaid in the same manner as a full-color image as compared with a roller fixing type fixing apparatus which passes a sheet of paper between a pair of fixing rollers to fix a toner image by heating and pressing.

Conventionally, according to the belt-type fixing apparatus, a fixing belt 4 was put around a heating roller 2 having for example a heater lamp 1 of 700 W at the rotation center therein and a support roller 3 to heat the fixing belt 4 in contact with the heating roller as shown in FIG. 1, a pressure roller 6 was contacted under pressure to a position facing the support roller 3 through the fixing belt 4, and a sheet of paper 7 was passed through a nip section formed by the fixing belt 4 heated to a fixable temperature by the heating roller 2 and the pressure roller 6 so to fix a toner image by heating and pressing.

And, Japanese Patent Application Laid-Open Publication No. 11-344885 discloses that a heating roller has therein heater lamps having larger and smaller sizes to heat a fixing belt. Such conventional heater lamps with larger and smaller sizes are designed to be switched from the larger heater lamp to the smaller heater lamp to prevent the surface temperature of a none-paper passing section of the heating roller from rising excessively when small size sheets of paper are successively conveyed, thereby providing a long life and safety of the heating roller.

Generally, the fixing apparatus needs a high-temperature heating source and its electric power consumption is about 60 to 70% of a total electric power consumption of the image forming device. Therefore, the belt type fixing apparatus is required to save the electric power consumption at the fixing operation without degradation of speed-up in response to the demand for the speed-up and the saving of the electric power consumption of the image forming device lately. The aforesaid fixing apparatus, however, is not designed to achieve the saving of the electric power consumption.

As one means to realize the saving of the electric power consumption of the fixing apparatus, it is effective to reduce the power consumption of the heating source at the fixing operation. At the same time, the power requirements of the fixing apparatus can be reduced by shortening a warm-up time for raising the fixing belt to a predetermined temperature after turning on the image forming device or by shortening the first copying time from a stand-by state for the next fixing operation after completing the fixing operation to a temperature increase of the fixing belt to a fusable state.

But, the heat source of the fixing apparatus is generally required to be set to have high output so that a good fixing property can be obtained even for a developed image such as a full-color image having a large amount of toner used for overlaying multicolor. Therefore, the same high-output heating source must be used for even a developed image with a little amount of toner such as a monochrome text image, resulting in consuming an excessive power for the developed image with a small amount of toner.

Besides, the heating source is always under ON/OFF control in order to keep the fixing temperature in a predetermined range during the fixing operation, but the temperature of the fixing belt involved in the ON/OFF operation of the heating source becomes considerably uneven when the heating source has high output, and the fixed image is caused to have an uneven gloss due to the uneven temperature of the fixing belt. Meanwhile, it is desired recently that the uneven gloss caused by the uneven temperature is reduced as low as possible when a full-color image is obtained from image data of digital photographs or the like, particularly when a high quality image is demanded.

Besides, when the heating source is determined to have high output in order to reduce the warm-up time or the first copy time, the high-output heating source must be ON/OFF controlled even in the stand-by state after warming up so to keep the stand-by state, resulting in increasing the power consumption in the stand-by state.

Therefore, the belt type fixing apparatus is desired to provide a good fixing property regardless of an amount of toner of the developed image while realizing the effective power saving and to improve the indication quality of the fixed image. Furthermore, it is desired that the power consumption is also reduced in the stand-by state when the warm-up time and the first copy time are reduced in order to provide the effective power reduction.

SUMMARY OF THE INVENTION

It is an object of the invention to reduce the electric power consumption of a fixing belt type fixing apparatus, which can finely deal with various developing images, during a fixing operation without lowering the indication quality of a fixed image.

It is also an object of the invention to reduce the power consumption even in the stand-by state when the warm-up time and the first copy time are reduced to speed up the fixing time and the power consumption at warming up and first copying is reduced in the fixing belt type fixing apparatus.

The invention provides a fixing apparatus, which comprises first heating means, which form an endless belt shape, for heating a recording medium having a developing agent image thereon; pressing means, which form a roller shape, for fixing the developing agent image by catching and conveying the recording medium in cooperation with the first heating means; second heating means, which form a roller shape and come into contact with the first heating means, for heating the first heating means to a predetermined temperature; a plurality of heating means, which are disposed in the second heating means and have different output, for heating the second heating means entirely in the longitudinal direction; and control means for controlling the plurality of heating means.

The invention also provides a fixing apparatus which comprises a fixing belt, which forms an endless belt shape, to configured to heat a recording medium having a developing agent image thereon; a pressing roller, which forms a roller shape, configured to fix the developing agent image by catching and conveying the recording medium in cooperation with the fixing belt; a heating roller, which forms a roller shape and comes into contact with the fixing belt, configured to heat the fixing belt to a predetermined temperature; a plurality of heater lamps, which are disposed in the heating roller and have different output, to heat the heating roller entirely in the longitudinal direction; and a control device configured to control the plurality of heater lamps.

The invention also provides a fixing method for fixing a developing agent image by heating and pressing by conveying a recording medium having the developing agent image while holding it between a fixing belt heated in contact with a heating roller and a pressing roller, comprising the steps of heating the heating roller by selectively controlling to turn ON/OFF a plurality of heater lamps which are disposed in the heating roller, have different output and can heat the heating roller entirely in its longitudinal direction; heating the fixing belt by contacting the heating roller to the fixing belt; and passing the recording medium through a nip section formed between the fixing belt which is separated from the heating roller and the pressing roller which is in pressing contact with the fixing belt.

BRIEF DESCRIPTION OF THE DRAWINGS

FIG. 5 is a table showing the ON/OFF control of heater lamps for a temperature-increase mode or an image mode formed on a sheet of paper of the fixing apparatuss of the first and second embodiments of the invention.

DETAILED DESCRIPTION OF THE PREFERRED EMBODIMENTS

Figure 1:
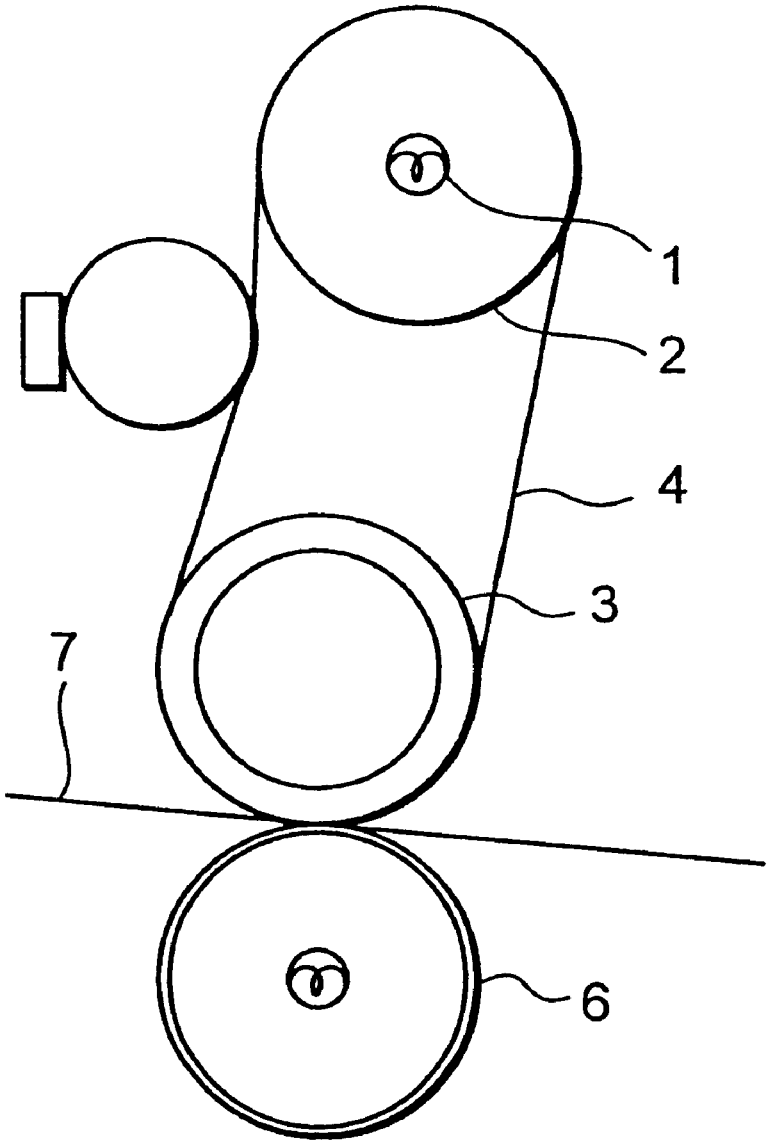
FIG. 1 PRIOR ART
FIG. 1 is an explanatory diagram schematically showing a conventional fixing apparatus.
Figure 2:
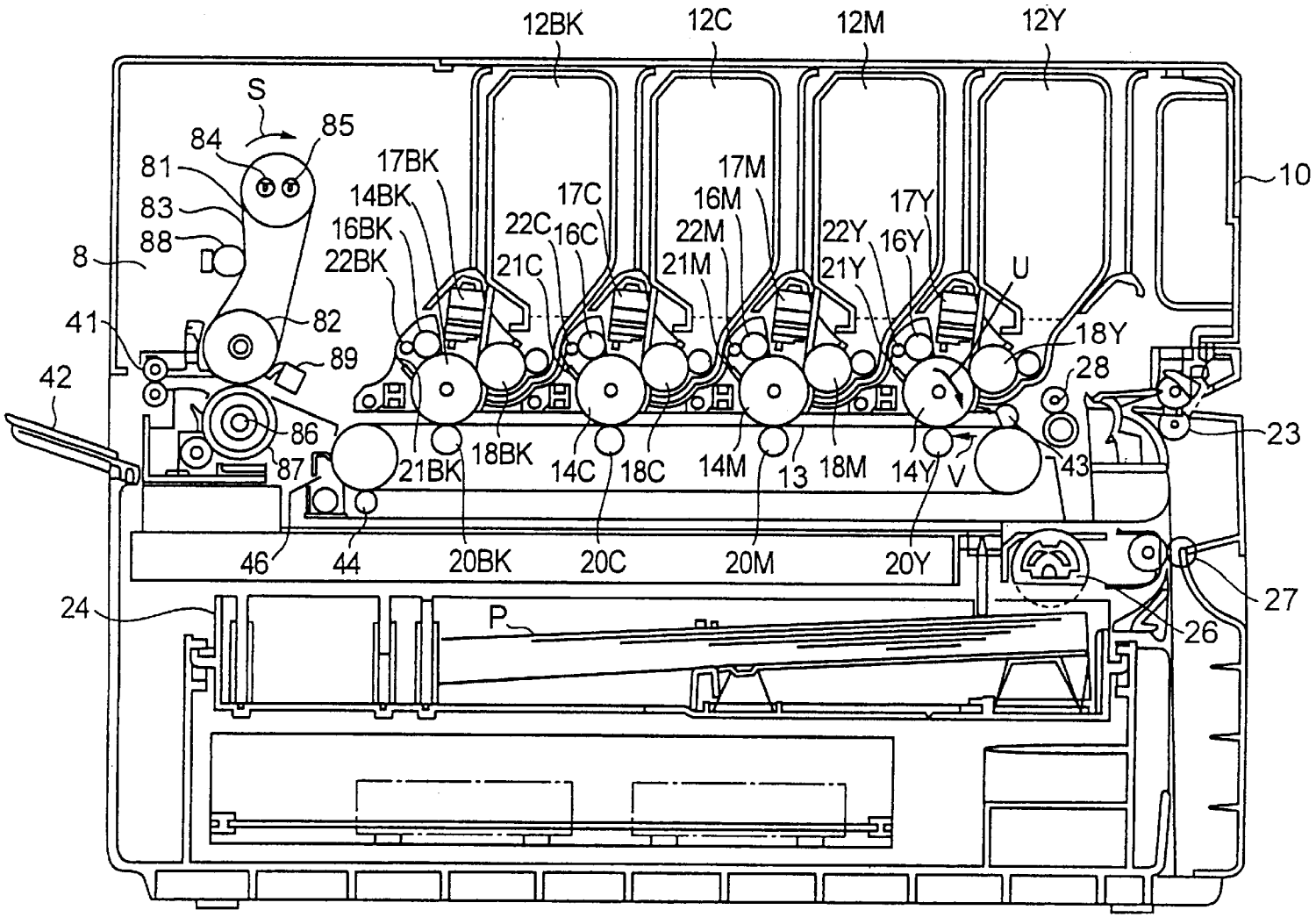
FIG. 2 is a structural diagram schematically showing an image forming section of a quaternate tandem type full-color printer on which the fixing apparatus of a first embodiment of the invention is fitted.
Figure 3:
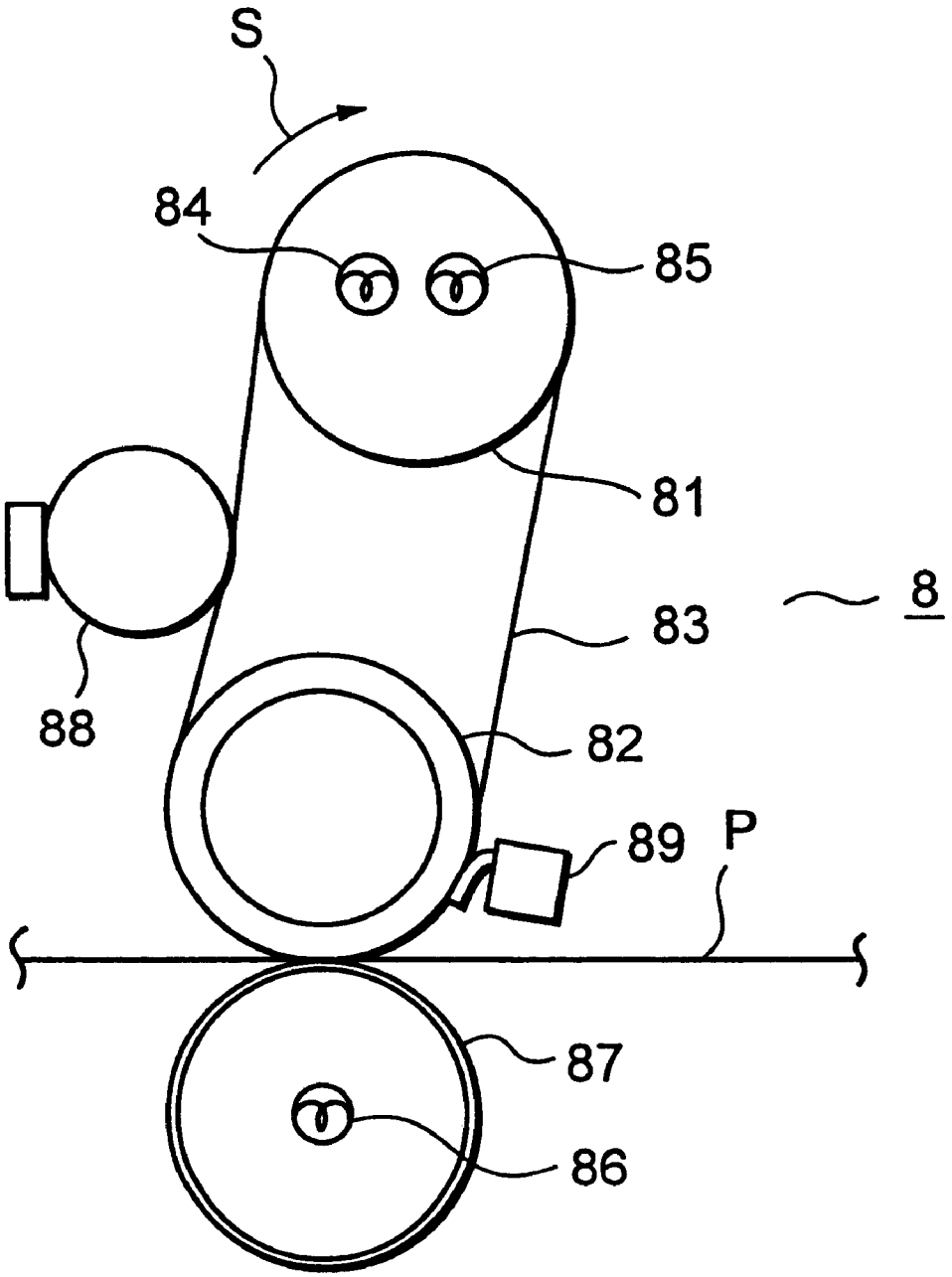
FIG. 3 is an explanatory diagram schematically showing the fixing apparatus of the first embodiment of the invention.

Preferred embodiments of the invention will be described in detail with reference to the accompanying drawings. FIG. 2 is a schematic structural diagram showing an image forming section 10 of a quaternate tandem type full-color printer, on which a belt type fixing apparatus 8 of the first embodiment of the invention is mounted. In the image forming section 10, four recording units 12Y, 12M, 12C, 12BK for forming respective color images by using respective toners of yellow (Y), magenta (M), cyan (C) and black (BK) are arranged in series along a transfer conveying belt 13 for conveying a sheet of paper.

The respective recording units 12Y, 12M, 12C, 12BK have the same structure, so that the following description will be made with reference to the recording unit 12Y for yellow (Y) which is disposed at the front, and the other recording units 12M, 12C, 12BK will be given like reference numerals for like components with subscripts added to indicate the respective colors, and their description will be omitted.

The recording unit 12Y has a photosensitive drum 14Y, around which an electrification device 16Y, an exposure device 17Y for irradiating a signal of light of yellow (Y), a developing device 18Y, a transfer roller 20Y, a cleaning device 21Y and an electrical charge removing device 22Y are disposed in this order in a direction of its rotation. The transfer roller 20Y is disposed to face the photosensitive drum 14Y with the transfer conveying belt 13 between them.

A paper feed cassette device 24 which accommodates sheets of paper P as a recording medium, a pick-up roller 26 for taking out the sheets of paper P from the paper feed cassette device 24, a feed roller 27 for conveying the sheets of paper P taken from the paper feed cassette device 24, and a resist roller 28 for feeding the sheets of paper P to the transfer conveying belt 13 with timing are disposed beneath the recording units 12Y, 12M, 12C, 12BK. The sheet of paper P is determined to be conveyed by the resist roller 28 and the transfer conveying belt 13 at a speed equivalent to the peripheral speeds of the photosensitive drums 14Y, 14M, 14C, 14BK. Reference numeral 23 denotes a manual paper feed roller for supplying the sheet of paper P manually.

The belt type fixing apparatus 8, a pair of paper discharge rollers 41 and a discharge paper tray 42 are disposed downstream of the transfer conveying belt 13. Reference numeral 43 is an adsorption roller which applies an electric charge to adsorb the sheet of paper P to the transfer conveying belt 13, 44 is a roller for removing the electric charge from the transfer conveying belt 13, and 46 is a transfer conveying belt cleaner.

Such a quaternate tandem type full-color printer forms text images in monochrome or multicolor or images in various modes such as photograph images in full color if necessary. In any of them, the images are output at the same speed, and the intervals of the sheets of paper P reaching the fixing apparatus 8 at the continuous printing are the same for a monochrome image and a full-color image.

The belt-type fixing apparatus 8 will be described in detail below. An endless belt type fixing belt 83 having a thickness of 0.3 mm which is first heating means and has a polyimide substrate coated with silicone rubber is put around a heating roller 81 which is second heating means and made of an aluminum (Al) cylinder having a coremetal thickness of 3 mm and a support roller 82 which has a stainless steel core covered with a 6 mm-thick silicone rubber. A thermistor 89 for detecting a surface temperature of the fixing belt 83 is disposed in contact with the neighborhood of the fixing position of the fixing belt 83.

A heater lamp 84 having high output of 500 W and a heater lamp 85 having low output of 200 W which are heating means are disposed in the hollow section of the heating roller 81. The high-output heater lamp 84 is disposed upstream of the fixing belt 83 in its conveying direction as compared with the low-output heater lamp 85 in a contact area of the heating roller 81 and the fixing belt 83. It is because heating the fixing belt 83 quickly at the upstream portion of the fixing belt 83 in the conveying direction makes it quick to raise the temperature of the fixing belt 83 by heating later. As a result, the time of raising the temperature of the fixing belt 83 can be shortened as compared with the case that the low-output heater lamp 85 is disposed at the upstream portion of the fixing belt 83 in the conveying direction. Both the high-output heater lamp 84 and the low-output heater lamp 85 have substantially the same length as the heating roller 81 in its longitudinal direction so that the heating roller 81 can be heated uniformly in its longitudinal direction.

A pressing roller 87, which is pressing means having a stainless steel core coated with silicone rubber having a thickness of 1.5 mm and a heater lamp 86 at the rotation center in its hollow interior, is disposed in pressing contact with the support roller 82 of the fixing belt 83 which is put around the heating roller 81 and the support roller 82. An oil application roller 88 for applying a silicone oil to the fixing belt 83 is in contact with the outer surface of the fixing belt 83.

Figure 4:
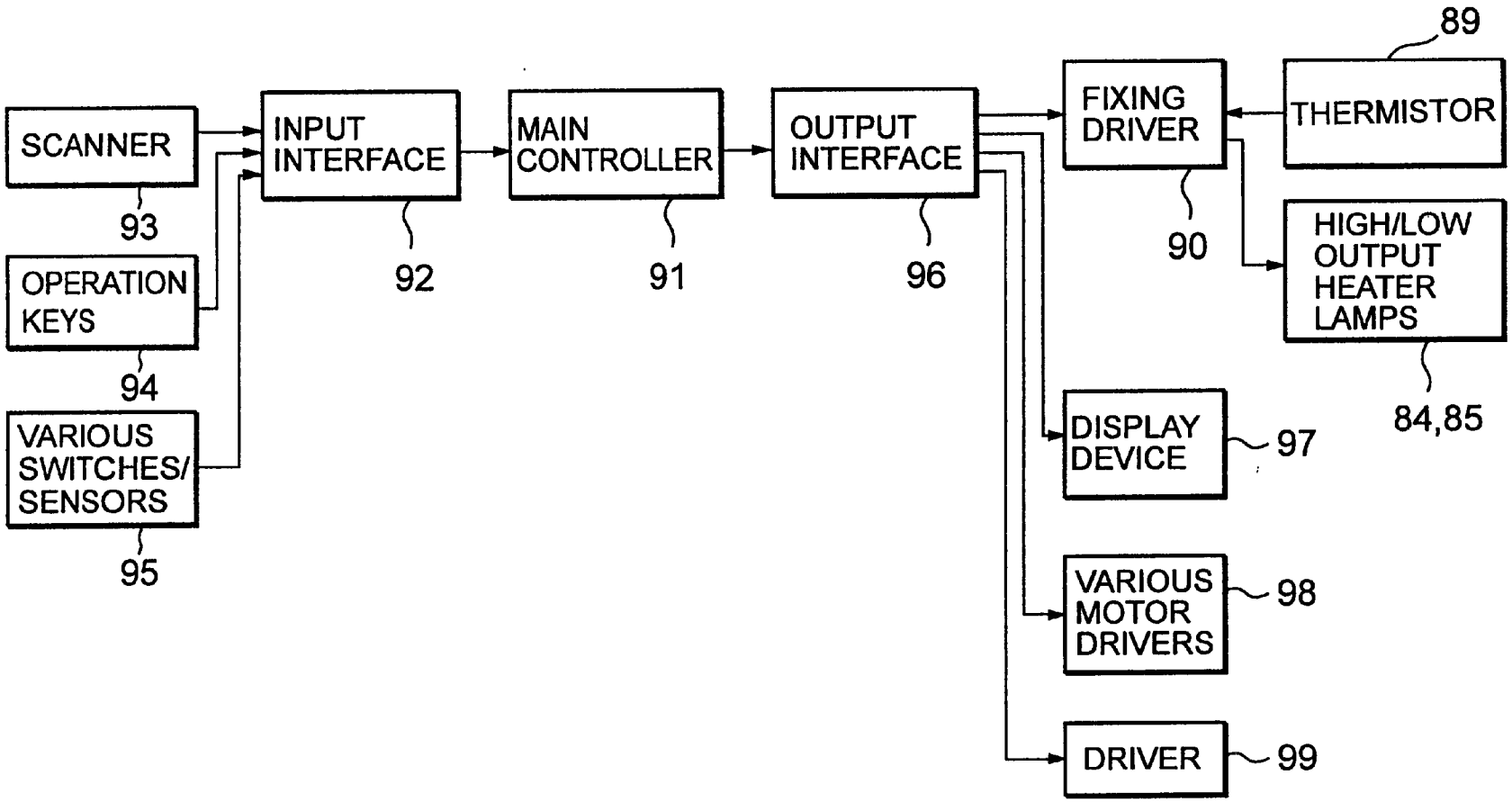
FIG. 4 is a block diagram schematically showing the control of a color printer of the first embodiment of the invention.

The high-output heater lamp 84 and the low-output heater lamp 85 in the hollow interior of the heating roller 81 are controlled to be turned ON/OFF by a fixing driver 90 depending on a temperature-raising mode of the fixing apparatus 8, an image mode for fixing by the fixing apparatus 8, and properties such as a thickness and material of the sheet of paper P. The fixing driver 90 is controlled by a main controller 91 for controlling the full-color printer as shown in FIG. 4.

The main controller 91 is connected to a scanner 93 for entering image information through an input interface 92, operation keys 94 on an operation panel (not shown) which can enter selection of a print mode, the number of sheets of paper and the like and various switches/sensors 95. And, the main controller 91 is connected to a display device 97 on the operation panel (not shown), respective motor drivers 98 for controlling a motor and others for driving the heating roller 81 of the fixing apparatus 8, a driver 99 for controlling ON/OFF of a transfer roller 20, an electrical charge removing device 22 and the like and the fixing driver 90 through the output interface 96.

The result of detecting the temperature of the fixing belt 83 is entered the fixing driver 90 from a thermistor 89, and ON/OFF of the high-output heater lamp 84 and the low-output heater lamp 85 is controlled.

The fixing apparatus 8 configured as described above enters the sheet of paper P having a toner image thereon into the nip portion formed by the fixing belt 83 heated to a fusable temperature and the pressing roller 87 which is in pressing contact with the fixing belt 83 to fix the toner image by heating and pressing. During the above operation, ON/OFF of the high-output heater lamp 84 and the low-output heater lamp 85 is selectively controlled according to the temperature increase mode of the fixing belt 83, the image mode of the sheet of paper P and the like.

Then, an operation will be described. First, when the power is turned on, the fixing apparatus 8 starts the warm-up operation in the warm-up mode. Specifically, in the warm-up mode, the fixing belt 83 has to be increased its temperature quickly from room temperature (20° C.) to a predetermined temperature 160° C., so that both of the 500 W high-output heater lamp 84 and the 200 W low-output heater lamp 85 in the heating roller 81 are turned ON, and the fixing belt 83 is rotated in the direction of an arrow s by driving the heating roller 81.

After warm-up is started, when the thermistor 89 detects that the fixing belt 83 has reached 160° C., the fixing driver 90 switches the high-output heater lamp 84 and the low-output heater lamp 85 to the stand-by mode. It took 120 sec. to raise the fixing belt 83 from room temperature to 160° C.

In the stand-by mode, the high-output heater lamp 84 is turned OFF, and only the low-output heater lamp 85 is controlled to be turned ON/OFF to perform the stand-by operation to keep the fixing belt 83 at the predetermined stand-by temperature of about 120° C. until the next printing operation is started. The fixing belt 83 which is raised to 160° C. by the warm-up operation can sufficiently keep the stand-by temperature of 120° C. by supplemental heating by the 200 W low-output heater lamp 84.

When printing is instructed to start through the operation keys 94 during the stand-by mode, the fixing driver 90 switches the high-output heater lamp 84 and the low-output heater lamp 85 to a first copy mode to start the first copy operation in the first copy mode.

In the first copy mode, the fixing belt 83 has to be raised from the stand-by temperature of 120° C. to the copyable temperature of 160° C. quickly, so that both of the high-output heater lamp 84 and the low-output heater lamp 85 are turned ON. When the thermistor 89 detects that the fixing belt 83 has reached 160° C., the printing operation is started according to the printing conditions input from the operation panel 94. FIG. 5 shows the ON/OFF states of the high-output heater lamp 84 and the low-output heater lamp 85 according to the temperature raising mode of the fixing apparatus 8.

Where a full-color image which is a color overlaying mode is printed in the printing operation, a plurality of toners are overlaid on the sheet of paper P using a large amount of toner, and a large amount of fixing heat is necessary. Therefore, both of the high-output heater lamp 84 and the low-output heater lamp 85 of the heating roller 81 are controlled to be turned ON/OFF to keep the fixing belt 83 at the fusable temperature of 160° C.

Where a text image is printed in a non-color overlaying mode, an amount of toner on the sheet of paper P is small, an amount of fixing heat required for fixing is small and a temperature drop of the fixing belt 83 by the fixing operation is small as compared with the full-color image, but the interval of reaching the sheet of paper P to the fixing apparatus is the same as in the printing of the full-color image, and the copyable temperature of 160° C. can be maintained even when the output of the heating roller 81 is lowered. Therefore, the 200 W low-output heater lamp 8 is turned OFF, and only the 500 W high-output heater lamp 84 is controlled to be turned ON/OFF, so that the fixing operation is performed in a state that the total output is lowered. FIG. 5 shows the ON/OFF states of the high-output heater lamp 84 and the low-output heater lamp 85 according to the image mode on the sheet of paper P described above.

When printing is started, the image forming section 10 transfers the images formed by the respective recording units 12Y, 12M, 12C, 12BK onto the sheet of paper P according to image data entered from the scanner unit 93 and fixes by the fixing apparatus 8.

Specifically, to form a full-color image, for example the recording unit 12Y for yellow (Y) operates so that the photosensitive drum 14Y turns in a direction of an arrow u to perform the image forming steps sequentially, and it is first electrically charged uniformly by the electrification device 16Y. Then, the uniformly charged photosensitive drum 14Y is exposed by the exposure device 17Y to form a latent image corresponding to the image data of yellow (Y) on the photosensitive drum 14Y. Then, the photosensitive drum 14Y is developed by the developing device 18Y to form a toner image of yellow (Y) on the photosensitive drum 14Y.

Similarly, the respective recording units 12M, 12C, 12BK for magenta (M), cyan (C) and black (BK) form toner images of respective colors on the respective photosensitive drums 14M, 14C, 14BK.

In synchronization with the operation to form the toner images of respective colors on the photosensitive drums 14Y, 14M, 14C, 14BK, the pick-up roller 26 or the manual paper feed roller 23 is driven to supply the sheet of paper P from the paper feed cassette device 24 or by manually feeding, and the sheet of paper P is aligned its end by the resist roller 28 and forwarded to the transfer conveying belt 13.

The sheet of paper P sent to the transfer conveying belt 13 is conveyed in a state electrostatically adsorbed to the transfer conveying belt 13 by the electric charge given by the adsorption roller 43 in the direction of an arrow v as the transfer conveying belt 13 runs. A yellow toner image, a magenta toner image, a cyan toner image, and a black toner image are sequentially transferred and overlaid onto the sheet of paper P at the positions of the respective transfer rollers 20Y, 20M, 20C, 20BK to form a full-color toner image. And the sheet of paper P is conveyed to the fixing apparatus 8 where both of the high-output heater lamp 84 and the low-output heater lamp 85 are controlled to be turned ON/OFF to permanently fix the multicolor overlaid full-color toner image thereon.

Besides, after fixing, the sheet of paper P is discharged onto the discharge tray 42 through the pair of discharge rollers 41. After the sheet of paper P is peeled, the transfer conveying belt 13 is continuously driven to rotate so that it is cleaned to remove the adhered toner and paper dust by the belt cleaner 46. After cleaning, the transfer conveying belt 13 is removed the electrical charge by the transfer conveying belt electrical charge removing roller 44 so that its surface have uniform electric potential.

The respective photosensitive drums 14Y, 14M, 14C, 14BK having the toner images transferred are continuously rotated and cleaned to remove the remaining toner and paper dust by the cleaning devices 21Y, 21M, 21C, 21BK. After the cleaning, the photosensitive drums 14Y, 14M, 14C, 14BK are removed the electric potential from their surfaces by the electrical charge removing devices 22Y, 22M, 22C, 22BK and wait for the next full-color image forming process. The fixing belt 83 is also cleaned by the oil application roller 88.

For the text image, the sheet of paper P on which the monochrome or multicolor text image formed by the predetermined recording unit 12 is transferred is made the permanent fixing of the text image by the fixing apparatus 8 having only the high-output heater lamp 84 controlled to be turned ON/OFF.

Then, after the printing operation is terminated, the fixing apparatus 8 is switched to the stand-by mode, the high-output heater lamp 84 is turned OFF, and only the low-output heater lamp 85 is controlled to be turned ON/OFF to perform the standby operation until the next printing operation is started.

Where the power consumption per hour was measured by performing the continuous fixing operation by the fixing apparatus 8 using image data of a print ratio of 6%, it was 450 Wh, saving the amount of electricity compared with the power consumption of 600 Wh of a conventional fixing apparatus.

It is because the conventional fixing apparatus uses a heater lamp having output 700 W in either the color overlaying mode or the non-color overlaying mode, while this embodiment uses both of the high- and low-output heater lamps of 500 W and 200 W (700 W in total) in the full-color mode using a large amount of toner to overlay color toners, but uses only the heater lamp of 500 W in the text mode using a small amount of toner because fixing can be made sufficiently without requiring the high output of 700 W.

Where the temperature of the fixing belt 83 is controlled by turning ON/OFF the high-output heater lamp 84 of 500 W only, the non-uniform temperature caused on the fixing belt 83 by the ON/OFF control is small as compared with the heating by the heater lamp of 700 W, a gloss on the fixed image does not become uneven heavily, and the indication quality of the printed image can be improved.

As described above, the high-output heater lamp 84 and the low-output heater lamp 85 are disposed within the heating roller 81 to heat the fixing belt 83 and are controlled to be selectively turned ON/OFF depending on the temperature raising mode of the fixing apparatus 8 or the image mode of the sheet of paper P, so that the power consumption can be saved because only the low-output heater lamp 85 of 200 W is controlled to be turned ON/OFF in the standby mode to keep the standby temperature as compared with the conventional fixing apparatus using the 700 W heater lamp.

Besides, in the first copy mode, both of the high-output heater lamp 84 and the low-output heater lamp 85 are turned ON so to be ready quickly to heat the fixing belt 83, so that the standby temperature can be set lower, and additional power saving can be made.

Furthermore, in this embodiment of the quaternate tandem type, good fixing can be made by controlling to turn ON/OFF only the high-output heater lamp 84 of 500 W to print the text image, so that the power consumption can be reduced as compared with the existing fixing apparatus using the heater lamp of 700 W.

Then, a second embodiment of the invention will be described. The second embodiment uses the belt type fixing apparatus 8 used in the first embodiment and mounts it on an intermediate transfer type full-color printer. Therefore, like reference numerals are used in the second embodiment for like components as those of the first embodiment, and their descriptions will be omitted.

Figure 6:
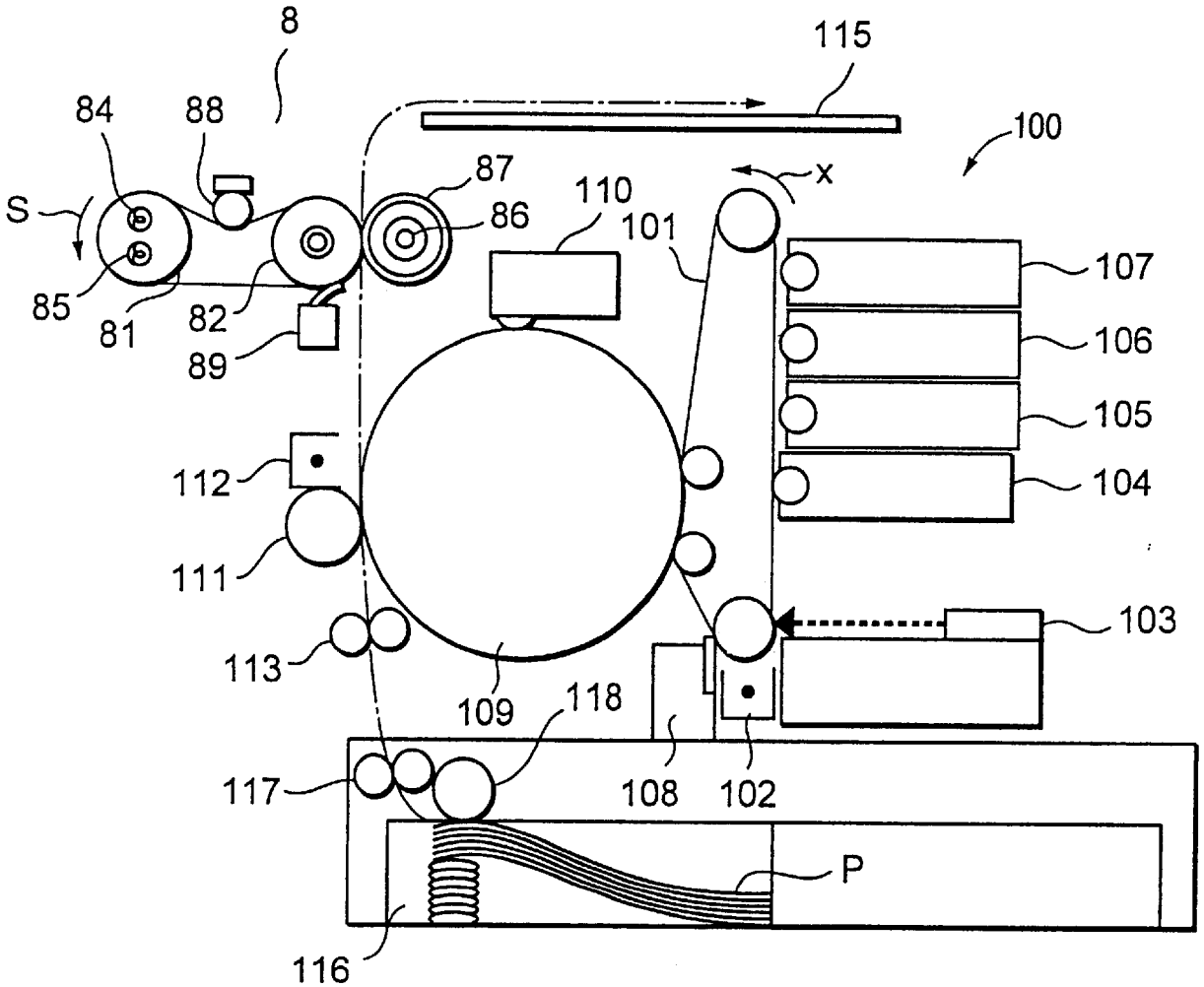
FIG. 6 is a structural diagram schematically showing an image forming section of an intermediate transfer type full-color printer on which the fixing apparatus of the second embodiment of the invention is fitted.

FIG. 6 is a schematic structural diagram showing an image forming section 100 of the intermediate transfer type full-color printer, which is provided with the belt type fixing apparatus 8. The image forming section 100 has an electrification device 102, an exposure device 103, and a black developing device 104, a cyan developing device 105, a magenta developing device 106 and a yellow developing device 107 for black (BK), cyan (C), magenta (M) and yellow (Y) disposed sequentially around the photosensitive belt 101. Besides, an intermediate transfer body 109 is disposed at a transfer position of the photosensitive belt 101 to contact with it with a nip width retained, and an electrical charge remover (not shown) and a photosensitive cleaner 108 are disposed downstream of the transfer position. A transfer roller 111 for transferring the toner image, which is transferred onto the intermediate transfer body 109, to the sheet of paper P is disposed to face the circumference of the intermediate transfer body 109, and an intermediate transfer body cleaner 110 for removing the remained toner after the transfer is disposed downstream of the transfer roller 111.

Furthermore, a paper feed cassette device 116 for housing sheets of paper P as the recording medium, a pickup roller 118 for taking the sheet of paper P from the paper feed cassette device 116, a forward roller 117 for conveying the sheet of paper P taken from the paper feed cassette device 116, and a resist roller 113 for supplying the sheet of paper P to the transfer roller 111 with timing are disposed beneath the photosensitive belt 101 and the intermediate transfer body 109.

And, a peeling charger 112 and the fixing apparatus 8 of the same peeling charger belt type as used in the first embodiment are disposed downstream of the transfer roller 111, and a paper discharge tray 115 is also disposed.

The intermediate transfer type full-color printer described above has an image output speed variable depending on the number of toners used for multilaying colors at printing. For example, toners are not overlaid in a case of a single color, so that an interval of the sheets of paper P reaching the fixing apparatus is so short as 0.3 sec., and where images are fixed continuously, a temperature drop of the fixing belt by every fixing is small, but the temperature has to be resumed quickly, so that it is necessary to increase the output of the heater lamp. On the other hand, four color toners are overlaid for full-color printing using a large mount of toner, an amount of heat for fixing is large, and a temperature drop of the fixing belt for every fixing becomes large. But, it takes a long time to form a toner image on the sheet of paper P, and an interval of the sheet of paper P reaching the fixing apparatus is so long as 4.8 sec. Thus, there is a sufficient time to resume the temperature of the fixing belt, so that the output of the heater lamp can be made small.

Here, the fixing apparatus 8 and the fixing driver 90 are the same as in the first embodiment and, therefore, their descriptions are omitted.

Then, an operation will be described. In the warm-up mode at the power on, the standby mode and the first copy mode, the ON/OFF states of the high-output heater lamp 84 and the low-output heater lamp 85 are the same as in the first embodiment, so that their descriptions will be omitted.

Where a full-color image is printed in the color overlaying mode at the printing operation, a plurality of toners are overlaid on the sheet of paper P using a large amount of toners and requiring a large amount of heat for fixing, but it takes a long time to form a full-color toner image, an interval of the sheet of paper P passing through the fixing apparatus 8 is long, and there is a sufficient time to resume the temperature of the fixing belt 83, so that only the high-output heater lamp 84 of the heating roller 81 is controlled to be turned ON/OFF to keep the fixing belt 83 at the copyable temperature of 160° C.

On the other hand, where a text image is printed in the non-color overlaying mode, an amount of toner on the sheet of paper P is small as compared with the full-color image, but the time for forming the toner image is short, so that the image output is quick, and the interval of the sheet of paper P passing through the fixing apparatus 8 is short. Therefore, it is necessary to return the temperature of the fixing temperature in a short time, so that both of the high-output heater lamp 84 and the low-output heater lamp 85 of the heating roller 81 are controlled to be turned ON/OFF to perform the fixing operation. FIG. 5 shows the ON/OFF states of the high-output heater lamp 84 and the low-output heater lamp 85 according to the image mode on the sheet of paper P described above.

When it is started to print, the image forming section 100 repeats the toner image forming process for respective colors according to the image data entered from the scanner unit 93 to fix the toner image transferred from the intermediate transfer body 109 onto the sheet of paper P by the fixing apparatus 8.

Specifically, in the case of the full-color image, the image forming process is sequentially performed according to the rotations of the photosensitive belt 101 in the direction of an arrow x, and the photosensitive belt 101 is first electrically charged uniformly by the electrification device 102. Then, the uniformly charged photosensitive belt 101 is exposed by the exposing device 103 to form a latent image corresponding to the image data of yellow (Y) on the photosensitive belt 101.

The photosensitive belt 101 is developed by the yellow developing device 107 to form a toner image of yellow (Y) on the photosensitive belt 101. The photosensitive belt 101 reached the transfer position to transfer the toner image of yellow (Y) to the intermediate transfer body 109. After the transfer, the photosensitive belt 101 is undergone an optical electrical charge removal by the electrical charge remover 120 and cleaned by the photosensitive cleaner 108.

The photosensitive belt 101 is electrically charged again by the electrification device 102 and formed a latent image corresponding to the image data of magenta (M) by the exposing device 103, developed by the magenta developing device 106 to form a toner image of magenta (M) on the photosensitive belt 101. The photosensitive belt 101 transfers the toner image of magenta (M) onto the intermediate transfer body 109 having the toner image of yellow (Y). Similarly, toner images of cyan (C) and black (BK) are transferred onto the intermediate transfer body 109 having the toner images of yellow (Y) and magenta (M) to form a full-color image on the intermediate transfer body 109.

In synchronization with the operation of forming the toner images of respective colors onto the intermediate transfer body 109, the sheet of paper P is fed by the pickup roller 118 from the paper feed cassette device 116. This sheet of paper P is aligned its end by the resist roller 113, supplied to between the intermediate transfer body 109 and the transfer roller 111 and has the full-color toner image secondary-transferred from the intermediate transfer body 109.

The sheet of paper P on which the full-color toner image is formed is separated from the intermediate transfer body 109 by the peeling charger 112, conveyed to the fixing apparatus 8 in which only the high-output heater lamp 84 is controlled to be turned ON/OFF so to permanently fix the full-color toner image with colors overlaid, and discharged to the paper discharge tray 115. Meanwhile, after the sheet of paper P is separated, the intermediate transfer body cleaner 110 comes into contact with the intermediate transfer body 109 to clean the remained toner and paper dust from the intermediate transfer body 109 to enable the next toner image transfer. The fixing belt 83 is also cleaned by the oil application roller 88.

In a case of a text image, on the other hand, the photosensitive belt 101 is rotated in the direction of the arrow x and electrically charged uniformly by the electrification device 102 and forms thereon a latent image corresponding to image data of black (BK). The photosensitive belt 101 is developed by the black developing device 104 to form thereon a toner image of black (BK). Then, the toner image of black (BK) is transferred from the photosensitive belt 101 to the intermediate transfer body 109, and at the same time, the sheet of paper P is conveyed to the transfer roller 111 and has the toner image of black (BK) transferred on it from the intermediate transfer body 109.

After the transfer, the photosensitive belt 101 is undergone an optical electrical charge removal by the electrical charge remover 120 and cleaned by the photosensitive cleaner 108 to be ready for the next image formation. On the other hand, the sheet of paper P on which the toner image of black (BK) for a monochrome text is transferred is separated from the intermediate transfer body 109 by the peeling charger 112, conveyed to the fixing apparatus 8 where both of the high-output heater lamp 84 and the low-output heater lamp 85 are controlled to be turned ON/OFF, permanently fixed the black text toner image thereon, and discharged onto the paper discharge tray 115. After the printing operation is terminated, the fixing apparatus 8 is switched to the standby mode, the high-output heater lamp 84 is turned OFF, and only the low-output heater lamp 85 is controlled to be turned ON/OFF to make the standby operation until the next printing operation is started.

Using the full-color image data, the continuous fixing operation was performed, and an amount of power consumption per one hour was measured. In this embodiment, the amount of power consumption was 450 Wh, indicating the reduction of electrical power consumption as compared with an amount of power consumption of 600 Wh of the conventional fixing apparatus.

It is because the conventional fixing apparatus uses a heater lamp having output of 700 W in either the full-color mode or the text mode, while this embodiment uses both of the high- and low-output heater lamps 84, 85 of 500 W and 200 W (700 W in total) in the monochrome text mode in which an image is output quickly, but uses only the high-output heater lamp of 500 W in the full-color mode in which an image is output slowly to sufficiently resume the temperature of the fixing belt 83 before the next sheet of paper P comes in position.

Where the temperature of the fixing belt 83 is controlled by turning ON/OFF the high-output heater lamp 84 of 500 W only to fix the full-color image, the non-uniform temperature caused on the fixing belt 83 by the ON/OFF control is small as compared with the heating by the heater lamp of 700 W, and a gloss on the fixed image does not become uneven heavily. And, for the full-color image required to have high indication quality, a good fixed image without uneven gloss is obtained, and the indication quality can be improved.

By configuring as described above, an amount of power consumption in the standby mode can be reduced by selectively controlling to turn ON/OFF the high-output heater lamp 84 and the low-output heater lamp 85 according to the temperature raising mode of the fixing apparatus 8 or the image mode of the sheet of paper P in the same way as in the first embodiment.

Besides, in this embodiment of the intermediate transfer type, good fixing can be obtained to print the full-color image by controlling ON/OFF of only the high power heater lamp of 500 W, so that the power consumption can be reduced as compared with the conventional fixing apparatus using the heater lamp of 700 W. A non-uniform temperature caused on the fixing belt 83 at the full-color image printing can be reduced, a non-uniform gloss can be prevented, and indication quality can be improved. Thus, it is particularly suitable for a full-color image required having high indication quality.

The invention is not limited to the above embodiments and can be modified variously without departing from the scope of the invention. For example, the materials and structures of the heating roller and the fixing belt are not limited. The material for the heating roller is not limited to aluminum (Al) as long as it can efficiently conduct heat from the heater lamp to the fixing belt, and the fixing belt may be made of any material as long as it can finely retain an amount of heat given from the heating roller 81 to the fixing position and has elasticity to provide a sufficient nip width with the pressing roller.

The number of heater lamps disposed within the heating roller, their output and the like are arbitrary as required, and the arrangement of the respective heater lamps in the heater lamp is also arbitrary. For example, the high-output heater lamp 84 and the low-output heater lamp 85 of the first embodiment are disposed reversely, and the low-output heater lamp 85 is disposed upstream of the fixing belt 83 in the conveying direction at the contact area of the heating roller 81 and the fixing belt 83 as compared with the high-output heater lamp 84 to warm up. Then, it took 130 sec. to warm up, while it took 120 sec. to raise the fixing belt 83 from room temperature to 160° C. in the first embodiment. Therefore, the temperature raising time can be made short by disposing the heater lamp having higher output upstream of the fixing belt 83 in the conveying direction.

Besides, the fusable temperature of the fixing belt and the determined temperature in the standby state are also arbitrary, and the heater lamps selectively used accordingly are also arbitrary. The operation mode to selectively control the plurality of heater lamps in the heating roller is not restricted. For example, where a text image is printed by the quaternate tandem type full-color printer of the first embodiment and an ordinary sheet of paper of about 80 g/m$^2$ is used as the sheet of paper P, only the high-output heater lamp 84 of 500 W is controlled to be turned ON/OFF when fixing, the text image can be fixed permanently. However, where the sheet of paper P is thick paper of 150 g/m$^2$ or more, the fixing belt 83 has a large temperature drop after fixing. Therefore, even though the text image has a small amount of toner, it is necessary to increase the output of the heater lamp. And, the fixing apparatus 8 controls to turn ON/OFF both of the high-output heater lamp 84 of 500 W and the low-output heater lamp 85 of 200 W to perform the fixing operation as shown in FIG. 5.

Besides, the operation mode may selectively use the plurality of heater lamps depending on whether the sheet of paper is of a type which is easy to have a gloss, and particularly where paper readily having a gloss is used, it has considerable inconsistencies in gloss which is caused on the fixed image due to a non-uniform temperature of the fixing belt. Therefore, the plurality of heater lamps in the heating roller may be used selectively in a range that the toner image can be fixed and to lower the output of heater lamps as low as possible.

Where the plurality of heating lamps used in the present invention were applied to the conventional roller fixing type heater roller in order to reduce the power consumption, the roller fixing type heating roller was poor in heat conduction because it required elasticity and had thick silicone rubber around its perimeter. Therefore, when the heater lamps are lowered their output, a temperature drop consumed by fixing could not be returned quickly, and a predetermined temperature cannot be maintained. Accordingly, it was necessary to keep heating by the heater lamps having high output to make good fixing, and it was not suitable. Thus, it was found that the invention which selectively used the plurality of heater lamps to reduce the power was effective means for the belt fixing type fixing apparatus using the fixing belt good in heat conduction.

As described above in detail, the invention disposes the plurality of heater lamps having different output in the heating roller for heating the fixing belt and controls to selectively turn ON/OFF the plurality of heater lamps according to the operation mode of the fixing apparatus, so that the fixing belt can be heated quickly when its temperature is raised, and after the temperature is raised, the standby temperature can be maintained by selecting the heater lamp having an appropriate output to heat the fixing belt. Thus, the power for standby operation can be reduced without degrading the warm-up time or the speed of first copying.

And, the heater lamp having output suitable depending on whether the image is a color overlaid image or a text image, the image output speed or the properties of the sheet of paper, is selectively controlled to be turned ON/OFF in the fixing operation, so to prevent the electric power from being consumed uselessly and to reduce the power. Besides, as the output of the heater lamp is lowered because of the power saving at the fixing operation, the non-uniform temperature of the fixing belt caused by the ON/OFF control of the heater lamps can be reduced. Thus, the non-uniform gloss of the fixed image can be prevented, the image quality can be improved, and particularly it is suitable to form a full-color photographs, such as an image required to prevent the non-uniform gloss.

What is claimed is:

1. A fixing apparatus comprising:

first heating mean comprising an endless belt, for heating a recording medium having a developing agent image thereon;

pressing means comprising a roller, for fixing the developing agent image by catching and conveying the recording medium in cooperation with the first heating means;

second heating means comprising a roller which comes into contact with the first heating means, for eating the first heating means to a predetermined temperature;

a plurality of heating means, which are disposed in the second heating means and have different outputs, for heating the second heating means entirely in the longitudinal direction; and control means for controlling the plurality of heating means;

wherein the heating means having a high output among the plurality of heating means is positioned upstream in the conveying direction of the first heating means in a contact area between the first heating means and the second heating means.

2. The fixing apparatus according to claim 1, wherein the control means selectively controls the plurality of heating means according to a temperature raising mode of the first heating means.

3. The fixing apparatus according to claim 2, wherein the raising mode of the first heating means includes a warm-up mode for raising room temperature at turning ON the power to a predetermined warm-up temperature, a standby mode for standing by until the next fixing operation is started after the warm-up is completed, and a copy mode for raising the standby mode temperature to a predetermined fixable temperature.

4. The fixing apparatus according to claim 3, wherein the plurality of heating means are high-output heating means and low-output heating means, and the control means turns ON both of the high-output heating means and the low-output heating means in the warm-up mode, turns ON only one of the high-output heating means of the low-output heating means in the standby mode, and turns ON both of the high-output heating means and the low-output heating means in the copy mode.

5. The fixing apparatus according to claim 1, wherein the control means selectively controls the plurality of heating means according to an image mode of the recording medium heated by the first heating means.

6. The fixing apparatus according to claim 5, wherein the image mode of the recording medium includes a color overlaying mode in that a plurality of developing agents are overlaid on the recording medium when an interval of passing the recording medium through the pressing means is constant regardless of a color overlaying frequency of the developing agents onto the recording medium and a non-color overlaying mode other than the color overlaying mode.

7. The fixing apparatus according to claim 6, wherein the plurality of heating means are high-output heating means and low-output heating means, and the control means controls to turn ON both of the high-output heating means and the low-output heating means in the color overlaying mode and controls to turn ON either the high-output heating means or the low-output heating means in the non-color overlaying mode.

8. The fixing apparatus according to claim 5, wherein the image mode of the recording medium includes a color overlaying mode in that a plurality of developing agents are overlaid on the recording medium and a non-color overlaying mode other than the color overlaying mode when an interval of passing the recording medium through the pressing means becomes long as a color overlaying frequency of the developing agents on the recording medium increases.

9. The fixing apparatus according to claim 8, wherein the plurality of heating means are high-output heating means and low-output heating means, and the control means controls to turn ON either the high-output heating means or the low-output heating means in the color overlaying mode and controls to turn ON both of the high-output heating means and the low-output heating means in the non-color overlaying mode.

10. The fixing apparatus according to claim 1, wherein the control means selectively controls the plurality of heating means according to a property of the recording medium heated by the first heating means.

11. A fixing apparatus comprising:

a fixing belt comprising an endless belt configured to heat a recording medium having a developing agent image thereon;

a pressing roller, configured to fix the developing agent image by catching and conveying the recording medium in cooperation with the fixing belt;

a heating roller, comprising a roller which comes into contact with the fixing belt, and which is configured to heat the fixing belt to a predetermined temperature;

a plurality of heater lamps, which are disposed in the heating roller and have different outputs, to heat the heating roller entirely in the longitudinal direction; and a control device configured to control the plurality of heater lamps;

wherein the heater lamp having a high output among the plurality of heater lamps is positioned upstream in the conveying direction of the fixing belt in a contact area between the fixing belt and the heating roller.

12. The fixing apparatus according to claim 11, wherein the control device selectively controls the plurality of heater lamps according to a temperature raising mode of the fixing belt.

13. The fixing apparatus according to claim 12, wherein the temperature raising mode of the fixing belt includes a warm-up mode for raising room temperature at turning ON the power to a predetermined warm-up temperature, a standby mode for standing by until the next fixing operation is started after the warm-up is completed, and a copy mode for raising the standby mode temperature to a predetermined fixable temperature.

14. The fixing apparatus according to claim 13, wherein the plurality of heater lamp are a high-output heater lamp and a low-output heater lamp, and the control device turns ON both of the high-output heater lamp and the low-output heater lamp in the warm-up mode, turns ON only one of the high-output heater lamp or the low-output heater lamp in the standby mode, and turns ON both of the high-output heater lamp and the low-output heater lamp in the copy mode.

15. The fixing apparatus according to claim 11, wherein the control device selectively controls the plurality of heater lamps according to an image mode of the recording medium heated by the fixing belt.

16. The fixing apparatus according to claim 15, wherein the image mode of the recording medium includes a color overlaying mode in that a plurality of developing agents are overlaid on the recording medium when an interval of passing the recording medium through the pressing roller is constant regardless of a color overlaying frequency of the developing agents on the recording medium and a non-color overlaying mode other than the color overlaying mode.

17. The fixing apparatus according to claim 16, wherein the plurality of heater lamps are a high-output heater lamp and a low-output heater lamp, and the control device controls to turn ON both of the high-output heater lamp and the low-output heater lamp in the color overlaying mode and controls to turn ON either the high-output heater lamp or the low-output heater lamp in the non-color overlaying mode.

18. The fixing apparatus according to claim 15, wherein the image mode of the recording medium includes a color overlaying mode in that a plurality of developing agents are overlaid on the recording medium when an interval of passing the recording medium through the pressing roller becomes long as a color overlaying frequency of the developing agents on the recording medium increases and a non-color overlaying mode other than the color overlaying mode.

19. The fixing apparatus according to claim 18, wherein the plurality of heater lamps are a high-output heater lamp and a low-output heater lamp, and the control device controls to turn ON either the high-output heater lamp and the low-output heater lamp in the color overlaying mode and controls to turn ON both of the high-output heater lamp and the low-output heater lamp in the non-color overlaying mode.

20. The fixing apparatus according to claim 11, wherein the control device selectively controls the plurality of heater lamps according to a property of the recording medium heated by the fixing belt.

21. An image forming apparatus comprising:

an image carrier on which a developing agent image is formed;

a fixing belt comprising an endless belt configured to heat a recording medium on which the developing agent image is transferred from the image carrier;

a pressing roller configured to fix the developing agent image by catching and conveying the recording medium in cooperation with the fixing belt;

a heating roller comprising a roller which comes into contact with the fixing belt and which is configured to heat the fixing belt to a predetermined temperature;

a plurality of heater lamps which are disposed in the heating roller, which have different outputs and which heat the heating roller entirely in the longitudinal direction; and a control device configured to control the plurality of heater lamps;

wherein a heater lamp having high output among the plurality of heater lamps is positioned upstream in a conveying direction of the fixing belt in a contact area between the fixing belt and the heating roller.

22. The image forming apparatus according to claim 21, wherein the plurality of heaters include a high-output heater and a low-output heater which has an output that is lower than the high-output heater.

23. The image forming apparatus according to claim 22, wherein the high-output heater and the low-output heater are substantially the heater same length in the longitudinal direction of the heating roller.

24. The image forming fixing apparatus according to claim 22, wherein the control device selectively controls the high-output heater and the low-output heater according to a temperature raising mode of the fixing belt.

25. The image forming apparatus according to claim 24, wherein the temperature raising mode of the fixing belt includes a warm-up mode for raising room temperature at turning ON the power to a predetermined warm-up temperature, a standby mode for standing by until the next fixing operation is started after the warm-up is completed, and a copy mode for raising the standby mode temperature to a predetermined fixing temperature.

26. The image forming apparatus according to claim 25, wherein the control device turns ON both of the high-output heater and the low-output heater in the warm-up mode, turns ON only one of the high-output heater or the low-output heater in the standby mode, and turns ON both of the high-output heater and the low-output theater in the copy mode.

27. The image forming apparatus according to claim 22, wherein the control device selectively controls the high-output heater and the low-output heater according to an image mode of the recording medium heated by the fixing belt.

28. The image forming apparatus according to claim 27, wherein the image mode of the recording medium includes a color overlaying mode in that a plurality of developing agents are overlaid on the recording medium when an interval of passing the recording medium through the pressing roller is constant regardless of a color overlaying frequency of the developing agents on the recording medium and a non-color overlaying mode other than the color overlaying mode.

29. The image forming apparatus according to claim 28, wherein the control device turns ON both of the high-output heater and the low-output heater in the color overlaying mode and turns ON either the high-output heater or the low-output heater in the non-color overlaying mode.

30. The image forming apparatus according to claim 27, wherein the image mode of the recording medium includes a color overlaying mode wherein a plurality of developing agents are overlaid on the recording medium when an interval of passing the recording medium through the pressing roller increases as a color overlaying frequency of the developing agents on the recording medium increases and a non-color overlaying mode other than the color overlaying mode.

31. The image forming apparatus according to claim 30, wherein the control device turns ON either the high-output heater and the low-output heater in the color overlaying mode and turns ON both of the high-output heater and the low-output heater in the non-color overlaying mode.

32. The image forming apparatus according to claim 22, wherein the control device selectively controls the high-output heater and the low-output heater according to a property of the recording medium heated by the fixing belt.

33. The image forming apparatus according to claim 32, wherein the property of the recording medium includes an ordinary recording medium mode and a thick recording medium mode, and wherein a thickness of the thick recording medium is thicker than a thickness of the ordinary recording medium.

34. The image forming apparatus according to claim 33, wherein the control device turns ON the high-output heater only in the ordinary recording medium mode and turns ON both of the high-output heater and low-output heater in the thick recording medium mode.

35. A fixing method for fixing a developing agent image by heating and pressing by conveying a recording medium having the developing agent image while holding it between a fixing belt heated in contact with a heating roller and a pressing roller, comprising the steps of:

heating the heating roller by selectively controlling to turn ON/OFF a plurality of heater lamps which are disposed in the heating roller, which have different outputs and can heat the heating roller entirely in its longitudinal direction, wherein the heater lamp having high output among the plurality of heater lamps is positioned upstream in the conveying direction of the fixing belt in a contact area between the fixing belt and the heating roller;

heating the fixing belt by contacting the heating roller to the fixing belt; and passing the recording medium through a nip section formed between the fixing belt which is separated from the heating roller and the pressing roller which is in pressing contact with he fixing belt.

* * * * *